US005144758A

United States Patent [19]

Skaugen et al.

[11] Patent Number: 5,144,758

[45] Date of Patent: Sep. 8, 1992

[54] APPARATUS FOR DRYING A WEB

[76] Inventors: Borgeir Skaugen, 3669 Oak La. Dr.; Gregory L. Wedel, 761 Morning Glory La., both of Beloit, Wis. 53511

[21] Appl. No.: 792,108

[22] Filed: Nov. 14, 1991

Related U.S. Application Data

[63] Continuation-in-part of Ser. No. 485,681, Feb. 27, 1990, Pat. No. 5,065,529, and a continuation-in-part of Ser. No. 167,672, Feb. 11, 1988, abandoned, and a continuation-in-part of Ser. No. 201,705, Jun. 2, 1988, abandoned, and a continuation-in-part of Ser. No. 230,627, Aug. 10, 1988, Pat. No. 4,945,655, and a continuation-in-part of Ser. No. 235,394, Aug. 23, 1988, Pat. No. 4,918,836, and a continuation-in-part of Ser. No. 243,742, Sep. 19, 1988, Pat. No. 4,980,979, and a continuation-in-part of Ser. No. 244,774, Sep. 14, 1988, Pat. No. 4,985,379, and a continuation-in-part of Ser. No. 417,978, Oct. 5, 1989, Pat. No. 4,970,805, which is a continuation-in-part of Ser. No. 14,569, Feb. 13, 1987, Pat. No. 4,934,067, which is a continuation-in-part of Ser. No. 431,961, Nov. 3, 1989, Pat. No. 5,101,577, which is a continuation-in-part of Ser. No. 429,730, Oct. 26, 1989, which is a continuation of Ser. No. 14,569, Feb. 13, 1987, Pat. No. 4,934,067.

[51] Int. Cl.[5] ..... F26B 13/08

[52] U.S. Cl. ..... 34/117; 34/114; 34/115

[58] Field of Search ..... 34/115, 116, 117, 114

[56] References Cited

U.S. PATENT DOCUMENTS

| | | |
|---|---|---|
| 2,537,129 | 1/1951 | Goodwillie . |
| 2,714,342 | 8/1955 | Beachler . |
| 2,959,222 | 11/1960 | Hornbostel . |
| 3,079,699 | 3/1963 | Fry, Jr. . |
| 3,110,612 | 11/1963 | Gottwald et al. . |
| 3,263,344 | 8/1966 | Stickle . |
| 3,395,073 | 7/1968 | Davis, Sr. . |
| 3,868,780 | 3/1975 | Soininen et al. . |
| 4,000,035 | 12/1976 | Schiel et al. . |
| 4,183,148 | 1/1980 | Koski et al. . |
| 4,202,113 | 5/1980 | Kankaanpaa . |
| 4,359,827 | 11/1982 | Thomas . |
| 4,359,828 | 11/1982 | Thomas . |
| 4,441,263 | 4/1984 | Vedenpää . |
| 4,481,723 | 11/1984 | Vedenpää . |
| 4,483,083 | 11/1984 | Chance . |
| 4,510,698 | 4/1985 | Ely . |
| 4,539,762 | 9/1985 | Eskelinen et al. . |
| 4,566,944 | 1/1986 | Mauranen et al. . |
| 4,608,124 | 8/1986 | Mauranen et al. . |
| 4,625,430 | 12/1986 | Aula et al. . |
| 4,625,434 | 12/1986 | Karlsson et al. . |
| 4,677,762 | 7/1987 | Futcher . |
| 4,686,778 | 8/1987 | Kotitschke et al. . |
| 4,986,009 | 1/1991 | Haessner et al. . |
| 5,062,216 | 11/1991 | Hannigan . |

FOREIGN PATENT DOCUMENTS

| | | |
|---|---|---|
| 2355397 | 11/1973 | Fed. Rep. of Germany . |
| 2813933 | 3/1978 | Fed. Rep. of Germany . |
| 3520070 | 12/1985 | Fed. Rep. of Germany . |
| 9001209 | 5/1990 | Fed. Rep. of Germany . |
| 6389996 | 6/1988 | Japan . |
| 2173832 | 10/1986 | United Kingdom . |
| 8202937 | 9/1982 | World Int. Prop. O. . |
| 8300514 | 2/1983 | World Int. Prop. O. . |
| 8804206 | 6/1988 | World Int. Prop. O. . |

OTHER PUBLICATIONS

"No. 16 Takes Shape", *Consolidated News*, vol. 29, No. 4, Aug.-Oct. 1991; pp. 8-9-10.

*Advances in Dryer Section Runnability*, by G. L. Wedel and S. Palazzolo; *TAPPI Journal*; Sep. 1987, pp. 65-69.

"Examining Runnability in the Dryer Section", by I. Binns; *Paper*, Jul. 1987; pp. 27-28.

"Neue Elemente Bei Der Papiertrocknung", by J. Fischer; Jun. 10, 1989.

*Primary Examiner*—Henry A. Bennet

*Attorney, Agent, or Firm*—Dirk J. Veneman; Raymond W. Campbell; David J. Archer

[57] ABSTRACT

A papermachine drying apparatus is disclosed for drying a first and a second side of the web. The apparatus includes a first single tier drying section for drying only the first side of the web. The first drying section includes a first plurality of dryer cylinders for drying the first side of the web, and a first plurality of vacuum rolls disposed in close proximity between adjacent dryer cylinders of the first plurality of dryer cylinders. A second single tier drying section for drying only the second side of the web in which the drying section includes a second plurality of dryer cylinders for drying the second side of the web, such cylinders being disposed immediately downstream relative to the first drying section. A second plurality of vacuum rolls are arranged such that each vacuum roll is disposed in close proximity between adjacent dryer cylinders of the second plurality of dryer cylinders. At least one of the vacuum rolls of the first and the second drying sections have a smaller diameter than the diameter of any of the dryer cylinders of the first and second drying sections, and the second drying section is a displaced downstream mirror image of the first drying section.

10 Claims, 10 Drawing Sheets

APPARATUS FOR DRYING A WEB

CROSS-REFERENCE TO RELATED APPLICATIONS

This is a Continuation-in-Part of co-pending U.S. patent application No. 07/485,681 filed Feb. 27, 1990, now U.S. Pat. No. 5,065,529 co-pending U.S. patent application No. 07/167,672 filed Feb. 11, 1988 now abandoned, co-pending U.S. patent application No. 07/201,705 filed Jun. 2, 1988 now abandoned, co-pending U.S. patent application No. 07/230,627 filed Aug. 10, 1988 now U.S. Pat. No. 4,945,655, copending U.S. patent application No. 07/235,394 filed Aug. 23, 1988 now U.S. Pat. No. 4,918,836, co-pending U.S. patent application No. 07/243,742 filed Sep. 9, 1988 now U.S. Pat. No. 4,980,970, co-pending U.S. patent application No. 07/244,774 filed Sep. 14, 1988 now U.S. Pat. No. 4,985,379, U.S. patent application No. 07/417,978 filed Oct. 5, 1989 now U.S. Pat. No. 4,970,805, all of which are continuation-in-part applications of U.S. patent application No. 07/014,569 filed Feb. 13, 1987, now U.S. Pat. No. 4,934,067. The subject application is also a continuation-in-part of co-pending U.S. patent application No. 07/431,961 filed Nov. 3, 1989 now U.S. Pat. No. 5,101,577, which is a continuation-in-part of co-pending U.S. patent application No. 07/429,730 filed Oct. 26, 1989, which is a continuation of U.S. patent application No. 07/014,569 filed Feb. 13, 1987, now U.S. Pat. No. 4,934,067. All the disclosure of the aforementioned co-pending patent applications are incorporated herein by reference.

BACKGROUND OF THE INVENTION

Field of the Invention

This invention relates to an apparatus for drying a web of paper emerging from a press section of a papermaking machine. More particularly, this invention relates to an apparatus for drying a web in which the web is transferred without open draw between dryer sections, thereby permitting threading of the web without the assistance of threading ropes and the drying of both sides of the web while continually restraining the web by felts.

INFORMATION DISCLOSURE STATEMENT

With the ever increasing operational speed of papermaking machines, a serious problem has existed in that there is a tendency for the paper web or sheet to flutter as the sheet progresses through the dryer section. Such sheet flutter is particularly evident when the sheet is transferred between succeeding sections of the dryer section as the web is transferred between these adjacent sections in an open draw. Such sheet flutter has been minimized by the use of single felting configurations in which the web and felt run jointly between respective top and bottom cylinders. However, the single felt configuration, although reducing the aforementioned problem of sheet flutter, introduces several disadvantages. Included amongst these disadvantages are, first, the heat transfer from the bottom cylinders is substantially reduced because the wet web is no longer in direct contact with the cylinders, the felt being interposed between the web and the drying surface of the respective cylinder. Second, the web has a tendency to separate from the felt as the web travels towards and around and then away from the bottom cylinder. Third, the initial threading of the web is not particularly easy.

A partial solution to the aforementioned single felt problems has been provided by the application of the so-called BelRun dryer section. BelRun is a registered trademark of Beloit Corporation. With the BelRun system, the bottom, ineffective dryers are replaced by vacuum rolls which positively convey the web from one cylinder to the next. Recent installations of this type of dryer section have shown that the BelRun concept can be extended to include a large number of dryers without any adverse effect on the web runnability. Such runnability results because the vacuum rolls are capable of conveying the web along the felt-supported spans without the need for sheet tension or section draw points.

With the implementation of the single BelRun section, there exists a tendency to have a generation of stresses which develop in the web as the web dries. Such stresses impart a tendency for the dried paper to curl. "Curl", according to "Pulp and Paper Dictionary" by John R. Lavigne, published 1986, is defined as "a paper or paper board deformation caused by non-uniform distribution of strains and stresses throughout the sheet as a result of an even internal moisture and conditioning." Such adverse curling effect can be minimized or eliminated by drying the web from both sides, but two-sided drying requires a transfer point in which the web is transferred from one felt to another felt. In the case of the present invention, the web must be alternately dried on a top tier dryer section and then on a bottom tier dryer section. A top tier section may be defined as a group of dryers in which the bottom surface of the web contacts the dryers. A bottom tier section conversely and correspondingly may be defined as a group of dryers in which the top surface of the web contacts the dryers.

In order to efficiently transfer the web from one section to another, a positive transfer arrangement is used. In the prior art, such means for transferring the web from one drying section to the next has required the introduction of an open draw with the associated problems of sheet flutter and the like.

Modern paper drying machines are contemplated in which web speeds of 10,000 or more feet per minute are envisaged. Consequently, the introduction of such open draws would lead to serious problems of sheet flutter and numerous web breakages. The present invention seeks to overcome the aforementioned inadequacies of the prior art apparatus and to provide a drying apparatus which contributes a significant and non-obvious contribution to the paper drying art.

Another object of the present invention is the provision of an apparatus for drying a web of paper emerging from a press section of a papermaking machine such that the web is transferred between a first and a second dryer section means without open draw, thereby permitting both threading of the web without the assistance of threading ropes and the drying of the web on both sides thereof.

Another object of the present invention is the provision of an apparatus for drying a web of paper which completely eliminates the need of open draws.

Another object of the present invention is the provision of an apparatus for drying a web of paper in which open draws for the sheet or web are eliminated.

Another object of the present invention is the provision of an apparatus for drying a web of paper in which blow boxes would be redundant.

Another object of the present invention is the provision of an apparatus for drying a web of paper in which ventilation of the pockets defined by the cylinders and the vacuum rolls is improved, thereby improving the drying rate of the web.

Another object of the present invention is the provision of an apparatus for drying a web of paper in which gear case leaks are inhibited and removal of broke is facilitated.

Another object of the present invention is the provision of an apparatus for drying a web of paper in which fewer steamfits are required and none of the dryers are redundant, thereby reducing the blow-through rate.

Another object of the present invention is the provision of an apparatus for drying a web of paper in which the frame is symmetrical and in which the base frame is subjected to equal loading forces, thereby resulting in a sturdy, low-profile frame which reduces vibration and its attendant noise level.

Another object of the present invention is the provision of an apparatus for drying a web of paper in which the power required to drive the cylinders is reduced and due to the layout and configuration of the dryers, such arrangement lends itself to the provision of a low-profile hood.

Another object of the present invention is the provision of an apparatus for drying a web of paper in which runnability of the drying apparatus is increased and in which doctors can be applied to each dryer.

Another object of the present invention is the provision of an apparatus for drying a web of paper which permits automatic threading of a tail and subsequent web therethrough.

Another object of the present invention is the provision of an apparatus for drying a web in which open access to the dryers and vacuum rolls is provided and a supply of air can be fed uniformly through each of the vacuum rolls.

Another object of the present invention is the provision of an apparatus for drying a web of paper in which hoods are provided over and adjacent the vacuum rolls for handling the humid exhaust and possibly eliminating the need for large scale exhaust hood construction.

Another object of the present invention is the provision of an apparatus for drying a web of paper in which such vacuum roll hoods can be provided for profiling the web by removing exhaust air from selected transfer sections of these hoods.

Another object of the present invention is the provision of an apparatus for drying a web ranging from lightweight grades to heavy board.

Another object of the present invention is the provision of an apparatus for drying a web of paper in which the humidity is decreased by eliminating the closed pockets associated with a typical two-felt type drying section.

Another object of the present invention is the provision of an apparatus for drying a web of paper in which the apparatus is no longer than a conventional dryer section but requires less equipment.

Another object of the present invention is the provision of an apparatus for drying a web of paper in which runnability is improved by eliminating open draws.

Another object of the present invention is the provision of an apparatus for drying a web of paper in which the felt-supported draw is reduced to a minimum.

Another object of the present invention is the provision of an apparatus for drying a web of paper in which sheet control and restraint is provided by the direct application of vacuum.

Another object of the present invention is the provision of an apparatus for drying a web of paper in which there is no need for residual sheet tension to hold the sheet against the felt since the sheet is entirely supported by vacuum as it wraps the transfer roll. In a conventional Uno-Run dryer section, a draw is required in order to induce a tension in the sheet to hold the sheet as it wraps the bottom dryer. Although blow boxes can be used to prevent the sheet from leaving the felt, the vacuum produced by these boxes is quite low—in the order of 0.05 to 0.1 inches WC (water column). Furthermore, the vacuum does not extend around the bottom dryer, and it is generally not sufficient to hold the sheet against centrifugal forces, and residual sheet tension is required to hold the sheet against the felt.

In the arrangement according to the present invention, the transfer roll vacuum is not so limited and, typically, 4 inches WC is applied to the web, which is more than four times the level needed for sheet support.

Another object of the present invention which is a less obvious factor relative to the runnability of the dryer section is the uniformity of dryer surface speeds. Such uniformity is obtained because the dryers are driven by the felt instead of by a gear train. Dryers which are geared together are forced to run at equal rotational speeds. In the case of dryers which have slightly different diameters, perhaps due to manufacturing tolerances or differences in steam pressure and temperature, such differences result in unequal dryer surface speeds. There unequal surface speeds not only increase the drive load but also cause problems with sheet runnability.

Another object of the present invention is the provision of an apparatus for drying a web of paper in which threading of the apparatus is simplified.

More specifically, in a conventional Uno-Run system, the tail tends to separate from the felt on the bottom dryers and wander in the cross-machine direction as it moves down the machine. In the dryer section, according to the present invention, the vacuum transfer rolls are equipped with internal dampers for concentrating the vacuum in front-side threading chambers. When these dampers are closed, the vacuum in the threading chambers is increased from 4 inches WC to 10–12 inches WC. Such vacuum holds the tail tightly to the felt and prevents the tail from wandering and stabilizes the entire threading operation.

Additionally, when the apparatus, according to the present invention, is extended through the entire dryer section, the tail can be threaded without the use of ropes. Special air nozzles are located near the edges of each dryer to insure that the tail follows the felt and is transferred by the vacuum rolls. These air nozzles eliminate the need for threading ropes, threading equipment and maintenance. Furthermore, the aforementioned threading arrangement helps to insure safe operation of the apparatus.

Also, when the ropes are removed, a wider felt can be used which tends to further stabilize the edges of the sheet on the felt.

With the open symmetrical framing, according to the present invention, broke removal, dryer access and dryer visibility are greatly improved. Additionally, although not a requirement of the present invention, each of the dryers can be easily fitted with a doctor, such doctors being unloaded automatically with air cylinders if required.

The apparatus, according to the present invention, permits a significant reduction in the amount of paper machinery which is required to meet the design production. In addition to reducing the number of dryers, felt rolls and guides, there is also a corresponding reduction in the number of steamfits, the elimination of blow boxes and pocket ventilation ducts. Also, the present invention enables simplification of the dryer framing.

With the application of the "Silent Drive" dryer system (Silent Drive is a registered trademark of Beloit Corporation) and, additionally, with the low profile afforded by the framing layout of the present invention, dryer section noise and vibration will be reduced to a minimum. Furthermore, smaller drive motors can be installed due to the fact that the section inertia is reduced in view of the elimination of the bottom dryers utilized in a typical Uno-Run system. Additionally, the dryer hood can have a low profile construction, and hood door lifts can be installed on the back as well as the front of the machine.

Another object of the present invention is the provision of an apparatus for drying a web of paper in which the energy efficiency of the apparatus is improved.

More specifically, the dryer section of the present invention provides improved energy efficiency in the following three areas. First, the drive load is reduced by having fewer dryers and less steamfit drag. Second, the amount of blowthrough steam is reduced by minimizing the number of dryers. Third, the large blowthrough quantities associated with the bottom dryers of conventional Uno-Run type sections are entirely eliminated.

Another object of the present invention is the provision of an apparatus for drying a web of paper in which the quality of the sheet is improved.

More specifically, the dryer section, according to the present invention, has the capability of affecting the sheet properties as follows. First, the tensile strength and stretch of the web in the machine direction is improved. Second, the tensile strength and stretch of the web in the cross-machine direction is improved. Third, the tendency for the sheet to curl is reduced, and fourth, the tendency to generate edge cockles is reduced. According to the aforementioned "Pulp and Paper Dictionary" by John R. Lavigne, "cockle" is defined as "a paper defect appearing as a wrinkle caused by non-uniform shrinking due to uneven drying or sheet formation." Furthermore, "cockling" is defined as "the process of producing a ripple-like defect or intentionally creating this type of paper surface by controlled, uneven drying of the sheet under minimum tension conditions."

Once the sheet leaves the press section, the machine direction tensile and stretch are affected primarily by the press section draw and somewhat less by the draw between dryer sections. In conventional drying sections, these dryer draws are usually set as low as possible, but the minimum draw is dictated by runnability and sheet control. However, in the drying section, according to the present invention, there is no minimum draw requirement for runnability. Nevertheless, the machine direction properties can still be affected in the usual way by pulling a draw between sections if such is deemed desirable.

In a somewhat similar manner, the cross-machine direction tensile and stretch are affected by the cross-machine direction sheet restraint. In an open draw, there is no restraint, so the sheet freely shrinks (although this shrinkage is greatest at the edges). In operation of a typical Uno-Run type drying section, there is a degree of web restraint as evidenced by the increase in trim and the decrease in edge cockles.

In the drying section, according to the present invention, the sheet restraint is more positive than that provided by a typical Uno-Run system, and this further reduces any tendency for edge cockles to develop. With the improved restraint provided by the present invention, a slight increase in cross-machine direction tensile and a decrease in cross-machine direction stretch is evident. The decrease in cross-machine direction stretch is most pronounced at the edges where the sheet normally has the least restraint. Accordingly, the net effect, according to the present invention, will be a sheet with more uniform properties in the cross-machine direction.

The propensity to curl is caused by three factors as follows. First, fiber orientation; second, fines and filler (bonding) distribution; and, third, residual fiber stress.

The dryer section affects only the fiber stress. Curl is normally controlled by adjusting the drying from each side of the sheet by separate control of the top and bottom dryer steam pressures.

Accordingly, in the drying section, according to the present invention, such control is provided by adjusting the steam pressure in subsequent sections.

Another particularly important object of the present invention is the provision of an apparatus for drying fine paper grades where directionality is important. More particularly, restrained drying of the web is an important feature of the present invention in that it will not permit the edges of the sheet to shrink more than the center portion of the sheet. The key to restraining the sheet while it is not held between the felt and the dryer drum is the vacuum in the transfer, or turning roll, below adjacent drums and the vacuum means for transferring the web between dryer sections. The sheet may be restrained, as stated hereinbefore, by application of a vacuum within the range 1-10 inches WC and preferably approximately 4 inches WC.

Another object of the present invention is the provision of an apparatus for drying a web of paper in which the tendency of the web to flutter relative to the dryer felt draws is inhibited.

Another object of the present invention is the provision of an apparatus for drying a web of paper in which machine and cross-machine directional shrinkage is reduced.

Other objects and advantages of the present invention will be apparent to those skilled in the art by a consideration of the following detailed description taken in conjunction with the annexed drawings.

Although the detailed description and annexed drawings describe a preferred embodiment of the present invention, it should be appreciated by those skilled in the art that many variations and modifications of the present invention fall within the spirit and scope of the present invention as defined by the appended claims.

SUMMARY OF THE INVENTION

As used throughout this specification, the term "single tier" or "single tier drying section" refers to a drying section having sequential rows of dryers with the axes of rotation of the dryers in each row lying in a common plane.

Also, as used herein, the term "joint run of the felts" means a path of the felts wherein the felts are brought into sufficiently close proximity to each other to effect a transfer of the web from one felt to the other felt while minimizing web flutter. The joint run need not be a parallel run of the felts.

The present invention relates to a single tier drying section for drying a web. The drying section includes a dryer and a felt guided about the dryer such that the web is disposed between the dryer and the felt for drying a first side of the web. A further dryer is disposed downstream relative to the dryer, and a further felt is guided about the further dryer such that the web is disposed between the further dryer and the further felt for drying a second side of the web.

Dryer transfer means transfers the web from the dryer to the further dryer. The dryer transfer means transfers the web without open draw from the dryer to the further dryer. The transfer means also includes a joint run of the felt and the further felt such that the web is conveyed by the felt into close proximity to the further felt during passage through the joint run. Vacuum means are disposed downstream of the joint run for positively maintaining the web in close conformity with the further felt when the felt and further felt diverge relative to each other downstream of the joint run. The felt is free from restraining means on the side of the felt facing away from the web during passage of the felt and further felt through the joint run.

Also, a single tier drying section for drying a web includes a first plurality of dryer cylinders for drying a first side of the web. A first plurality of vacuum rolls are disposed such that each vacuum roll is disposed below and interposed between adjacent dryer cylinders of the first plurality of dryer cylinders.

Looped dryer felt means conveys the web in a serpentine path over the first plurality of dryer cylinders with the web disposed between the felt and the dryer cylinders and under the first plurality of vacuum rolls with the felt between the web and the vacuum rolls. The vacuum rolls are spaced in close proximity to their adjacent corresponding dryer cylinders such that a felt draw between each of the vacuum rolls and the corresponding dryer cylinders of the first plurality of dryer cylinders and the first plurality of vacuum rolls is minimal. The arrangement is such that any tendency of the web to flutter relative to the dryer felt draws is inhibited.

Each of the felt draws is free of restraint, and a second plurality of dryer cylinders dries a second side of the web.

A second plurality of vacuum rolls are disposed above and interposed between adjacent dryer cylinders of the second plurality of dryer cylinders.

A looped further dryer felt conveys the web in serpentine path under the second plurality of dryer cylinders and over the second plurality of vacuum rolls. The vacuum rolls are spaced in close proximity to their adjacent corresponding dryer cylinders such that a further felt draw between each of the vacuum rolls and the corresponding dryer cylinders of the second plurality of dryer cylinders is minimal. The arrangement is such that any tendency of the web to flutter relative to the further dryer felt draws is inhibited.

Each of the further felt draws is free of restraint, and the first plurality of dryer cylinders are disposed substantially horizontal in series.

The second plurality of dryer cylinders are disposed substantially horizontal in series following the first plurality of dryer cylinders.

Transfer means are disposed between the first and the second plurality of dryer cylinders for transferring the web from the felt means to the further felt without open draw.

The means includes at least one vacuum roll which is associated with the further felt. The vacuum roll has an internal suction gland which is positioned to remove the web from the looped dryer felt means and onto the further felt.

The present invention also includes a method of drying a web of paper emerging from a press section of a papermaking machine. The method includes the steps of transferring the web from the press section to a single tier first dryer section of the apparatus.

Drying of the first side of the web is initiated during passage of the web through the first dryer section.

The web is transferred without open draw between the first dryer section and a second dryer section. The web transfer is such that the web is reversed so that drying of a second side of the web is initiated during passage of the web through the second dryer section. The second side of the web is opposite to the first side of the web.

The method also includes the further step of transferring the web without open draw between subsequent dryer sections such that the first and second sides of the web are alternately exposed to the drying effect of the subsequent drying sections in sequence.

The web is restrained during passage through the drying sections for reducing machine and cross-machine directional shrinkage.

The present invention also includes a single tier drying section for drying a web. The drying section includes a first plurality of drying cylinders and a first plurality of vacuum rolls with each vacuum roll being disposed below and between adjacent drying cylinders of the first plurality of drying cylinders and being disposed in close proximity thereto.

A second plurality of drying cylinders are disposed downstream relative to the first plurality of drying cylinders.

A second plurality of vacuum rolls are arranged such that each of the vacuum rolls of the second plurality of vacuum rolls is disposed above and between adjacent drying cylinders of the second plurality of drying cylinders and disposed in close proximity thereto.

The first plurality of drying cylinders have axes of rotation which extend generally horizontally in a plane.

The second plurality of drying cylinders have axes of rotation which extend generally horizontally in a further plane. The arrangement is such that the plane and further plane are at different elevations.

More specifically, the plane is above the further plane.

Furthermore, each of the vacuum rolls of the first and second plurality of vacuum rolls have a diameter which is less than the diameter of the first and second plurality of dryer cylinders.

Additionally, a papermachine drying apparatus for drying a first and a second side of the web includes a first drying section for drying only the first side of the web.

The first drying section includes a first plurality of dryer cylinders for drying the first side of the web. Each dryer cylinder of the first plurality of dryer cylinders has an axis of rotation disposed in a first plane.

A first plurality of vacuum rolls are arranged such that each vacuum roll of the first plurality of vacuum rolls is disposed in close proximity between adjacent dryer cylinders of the first plurality of dryer cylinders. Each vacuum roll of the first plurality of vacuum rolls is disposed in a second plane.

A second drying section dries only the second side of the web, with the second drying section including a second plurality of dryer cylinders for drying the second side of the web. The second plurality of dryer cylinders is disposed immediately downstream relative to the first drying section. Each dryer cylinder of the second plurality of dryer cylinders has an axis of rotation disposed in a third plane.

A second plurality of vacuum rolls are arranged such that each vacuum roll of the second plurality of vacuum rolls is disposed in close proximity between adjacent dryer cylinders of the second plurality of dryer cylinders. Each vacuum roll of the second plurality of vacuum rolls is disposed in a fourth plane.

The fourth plane is disposed between the first and the second planes.

Additionally, at least one of the vacuum rolls of the first and the second plurality of vacuum rolls is smaller in diameter than the diameter of any of the dryer cylinders of the first and second drying sections.

At least one of the vacuum rolls of the first and the second plurality of vacuum rolls has a larger diameter than at least one of the remaining vacuum rolls of the first and the second plurality of vacuum rolls.

The first plurality of dryer cylinders are disposed as a single tier, and the second plurality of dryer cylinders are disposed as a further single tier.

Furthermore, the drying apparatus includes a dryer felt which cooperates with each of the dryer cylinders of the first drying section such that the web is disposed between the felt and the dryer cylinders for drying the first side of the web. The felt extends in serpentine configuration alternately around each dryer cylinder and each vacuum roll of the plurality of vacuum rolls so that the felt is disposed between the web and each of the vacuum rolls.

A further dryer felt cooperates with each of the dryer cylinders of the second drying section such that the web is disposed between the further felt and the dryer cylinders of the second drying section for drying the second side of the web. The further felt extends in serpentine configuration alternately around each dryer cylinder of the second drying section and each vacuum roll of the second plurality of vacuum rolls so that the further felt is disposed between the web and each of the vacuum rolls of the second plurality of vacuum rolls.

More specifically, the first, second, third and fourth planes are disposed substantially horizontally.

Additionally, a paper machine drying apparatus for drying a first and a second side of a web includes a first single tier drying section for drying only the first side of the web. The first drying section includes a first plurality of dryer cylinders for drying the first side of the web.

A first plurality of vacuum rolls are arranged such that each vacuum roll of the first plurality of vacuum rolls are disposed in close proximity between adjacent dryer cylinders of the first plurality of dryer cylinders.

A second single tier drying section dries only the second side of the web. The second drying section includes a second plurality of dryer cylinders for drying the second side of the web. The second plurality of dryer cylinders is disposed immediately downstream relative to the first drying section.

A second plurality of vacuum rolls are arranged such that each vacuum roll of the second plurality of vacuum rolls is disposed in close proximity between adjacent dryer cylinders of the second plurality of dryer cylinders.

At least one of the vacuum rolls of the first and second drying sections have a smaller diameter than the diameter of any of the dryer cylinders of the first and second drying sections.

The second drying section is arranged as a displaced downstream mirror image of the first drying section.

Additionally, a single tier drying section apparatus for drying a first and a second side of the web includes a single tier of dryer cylinders for drying the first side of the web. Each dryer cylinder has an axis of rotation disposed in a first plane.

A plurality of vacuum rolls are arranged such that each vacuum roll is disposed in close proximity between adjacent dryer cylinders of the single tier of dryer cylinders. Each vacuum roll of the plurality of vacuum rolls is disposed in a second plane.

A further single tier of dryer cylinders is disposed immediately downstream relative to the single tier of dryer cylinders for drying the second side of the web. Each dryer cylinder of the further single tier has an axis of rotation disposed in a third plane.

A further plurality of vacuum rolls are arranged such that each vacuum roll of the further plurality of vacuum rolls is disposed in close proximity between adjacent dryer cylinders of the further single tier of dryer cylinders. Each vacuum roll of the further plurality of vacuum rolls is disposed in a fourth plane. The second and fourth planes are co-planar, and the second and fourth planes are disposed between and spaced and parallel relative to the first and third planes.

More specifically, the first, second, third and fourth planes are disposed substantially horizontal.

Additionally, a single tier drying section apparatus for drying a first and a second side of a web includes a single tier of dryer cylinders for drying the first side of the web. Each dryer cylinder has an axis of rotation disposed in a first plane.

A plurality of vacuum rolls are arranged such that each vacuum roll is disposed in close proximity between adjacent dryer cylinders of the single tier of dryer cylinders. Each vacuum roll of the plurality of vacuum rolls is disposed in a second plane.

A further single tier of dryer cylinders is disposed immediately downstream relative to the single tier of dryer cylinders for drying the second side of the web. Each dryer cylinder of the further single tier has an axis of rotation disposed in a third plane.

A further plurality of vacuum rolls are arranged such that each vacuum roll of the further plurality of vacuum rolls is disposed in close proximity between adjacent dryer cylinders of the further single tier of dryer cylinders. Each vacuum roll of the further plurality of vacuum rolls is disposed in a fourth plane. The first and third planes are co-planar, and the first and third planes are disposed between and parallel relative to the second and fourth planes.

Although the following detailed description exemplifies particular embodiments of the present invention, it should be understood by those skilled in the art that the present invention is not limited to such an arrangements. Rather, the present invention, as defined by the appending claims, envisages a multitude of variations thereof, including a single felt extending around the dryers of the first and second dryer sections rather than using a first and second felt as shown in the drawings. Furthermore, although the present invention shows the drying apparatus with a first, second, third, fourth and fifth dryer section means, the present invention is not limited to such an arrangement, and the various dryer section means may be staggered and disposed in any configuration thereof in order to reduce the overall length of the drying section without the introduction of an open draw.

Various alternative methods of transferring the web from one dryer section to the next while reversing the web will be apparent to those skilled in the art, the important feature of all such arrangements being that the web is kept under restraint as it travels from one dryer section to the next dryer section.

BRIEF DESCRIPTION OF THE DRAWINGS

Similar reference characters refer to similar parts throughout the various embodiments of the present invention.

DETAILED DESCRIPTION OF THE PREFERRED EMBODIMENT

Figure 1:
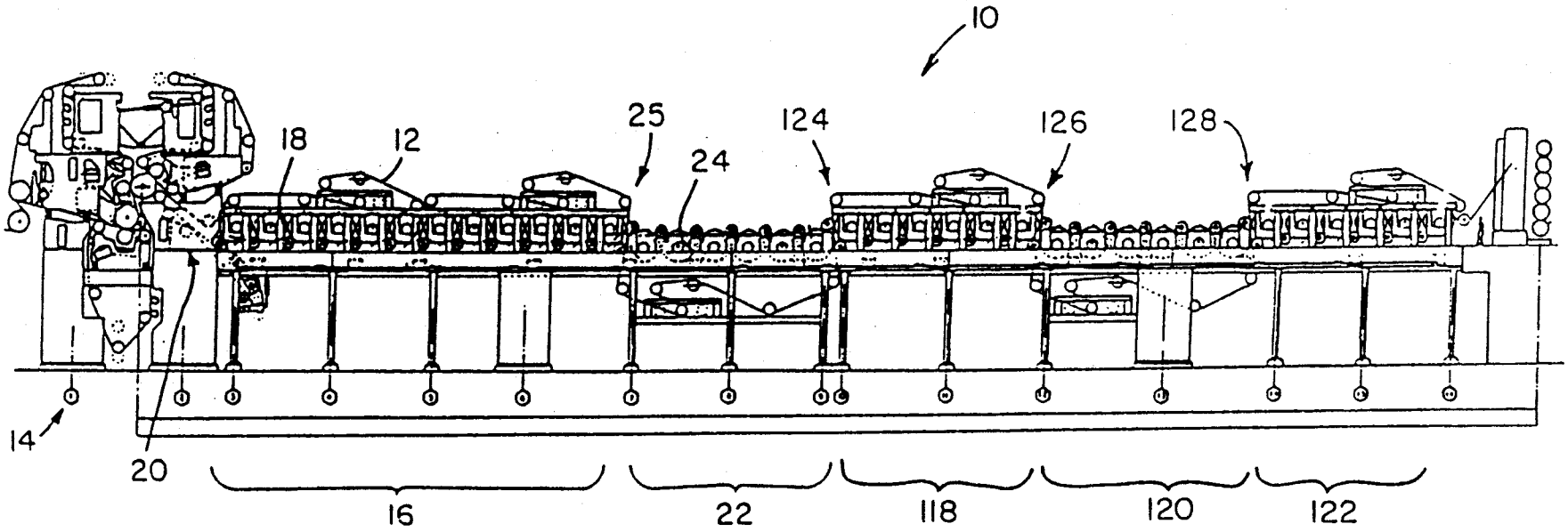
FIG. 1 is a side-elevation view of the apparatus according to the present invention showing the press section, the first transfer means, the first dryer section means, the second dryer section means, and the first dryer transfer means, according to the present invention.

FIG. 1 is a side-elevational view showing the apparatus, generally designated 10, for drying a web 12 of paper emerging from a press section, generally designated 14, of a papermaking machine. The apparatus 10 includes a first dryer section means, generally designated 16, for initiating the drying of a first side 18 of the web 12.

A first transfer means, generally designated 20, transfers the web 12 from the press section 14 to the first dryer section means 16.

A second dryer section means, generally designated 22, is disposed downstream relative to the first dryer section means 16. This second dryer section means 22 initiates the drying of a second side 24 of the web 12, the second side 24 of the web 12 being opposite to the first side 18 thereof.

A first dryer transfer means, generally designated 25, transfers the web 12 without open draw between the first and second dryer section means 16 and 22, respectively. The first dryer transfer means 25 permits both threading of the web 12 without the assistance of threading ropes and the drying of both sides 18 and 24 of the web 12.

Figure 2:
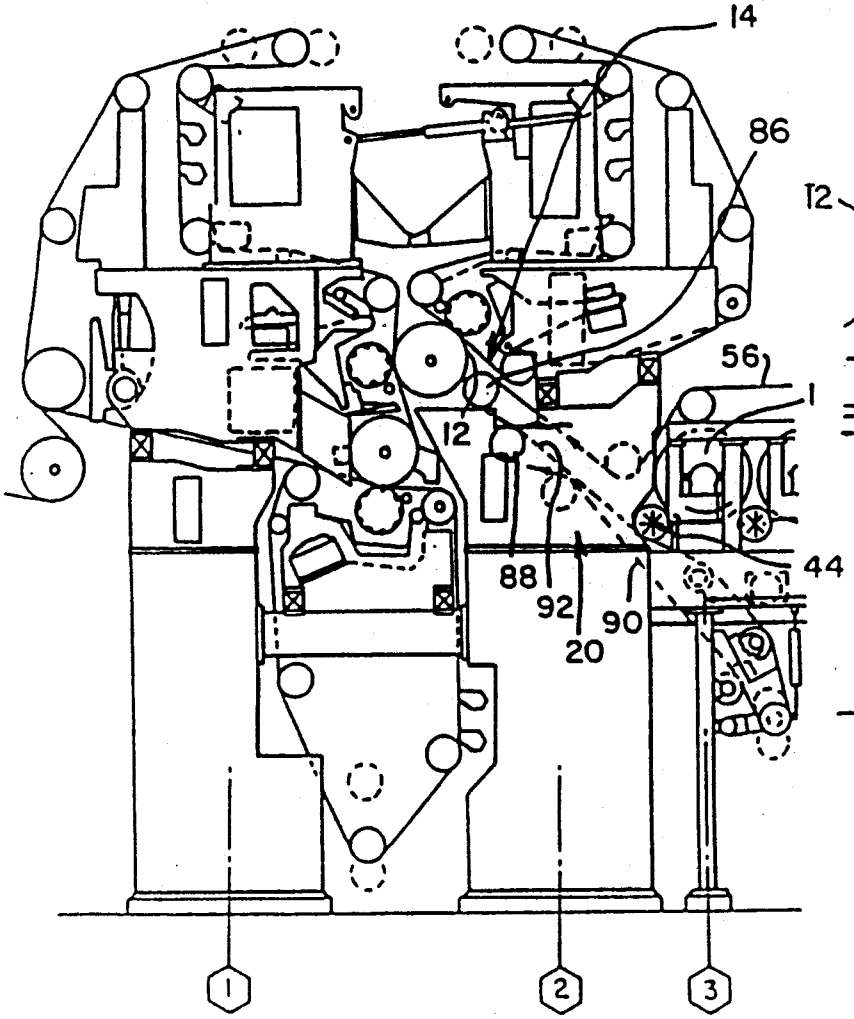
FIG. 2 is an enlarged fragmentary view of FIG. 1 showing the press section, and more particularly, the first transfer means for transferring the web from the press section to the first dryer section.

FIG. 2 shows in more detail the first transfer means 20 and will be described in more detail hereinafter.

Figure 3:
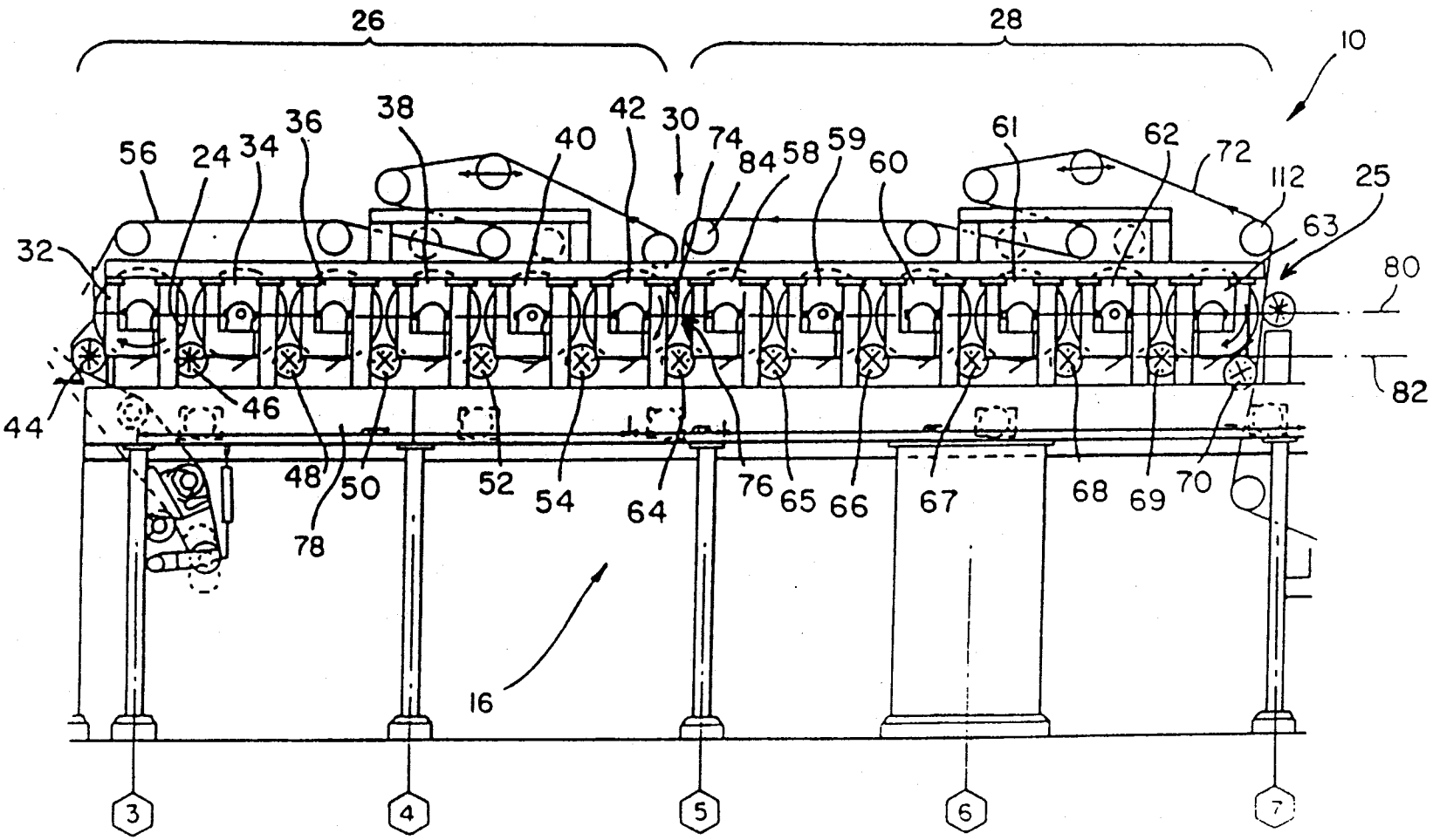
FIG. 3 is an enlarged fragmentary view of FIG. 1 showing the first dryer section means, including the first dryer section and the second dryer section.

FIG. 3 shows in detail the first dryer section means 16. This first dryer section means 16 includes a first dryer section, generally designated 26, for initiating the drying of the first side 18 of the web 12. The first dryer section means 16 also includes a second dryer section, generally designated 28, which is disposed downstream relative to the first dryer section 26 for continuing the drying of the first side 18 of the web 12. A second dryer transfer means, generally designated 30, transfers the web 12 without open draw between the first and the second dryer sections 26 and 28, respectively.

More particularly, with reference to FIG. 3, the first dryer section also includes a first plurality of dryers 32, 34, 36, 38, 40 and 42, respectively. The first dryer section 26 also includes a first plurality of vacuum rolls 44, 46, 48, 50, 52 and 54, respectively. The first plurality of vacuum rolls 44, 46, 48, 50, 52 and 54 are disposed adjacent to a corresponding drying of the first plurality of dryers 32, 34, 36, 38, 40 and 42 such that the web 12 extends alternately past each vacuum roll 44, 46, 48, 50, 52 and 54 and dryer 32, 34, 36, 38, 40 and 42 in serpentine configuration.

A first felt 56 extends around the first plurality of dryers 32, 34, 36, 38, 40 and 42 and the first plurality of vacuum rolls 44, 46, 48, 50, 52 and 54 in close conformity with the web 12.

The second dryer section 28 also includes a second plurality of dryers 58, 59, 60, 61, 62 and 63.

The second dryer section 28 also includes a second plurality of vacuum rolls 64, 65, 66, 67, 68, 69 and 70. The vacuum rolls 64 to 70 are disposed adjacent to a corresponding dryer of the second plurality of dryers 58 to 63 such that the web 12 extends alternately past each configuration.

A second felt 72 extends around the second plurality of dryers 58 to 63 and the vacuum rolls 64 to 70, respectively, such that the second felt 72 is disposed in close conformity with the web 12.

The second felt 72 and an unfelted portion 74 of the downstream dryer 42 of said first dryers 32, 34, 36, 38, 40 and 42 defines a first pick-up section, generally designated 76, for transferring the web 12 from the unfelted portion 74 onto the second felt 72 so that the web 12 is transferred without draw from the first dryer section 26 to the second dryer section 28.

Each of the vacuum rolls of the first and the second dryer sections 26 to 28 are disposed in close proximity to their adjacent corresponding dryers such that the felt draw between each of the vacuum rolls and their corresponding dryers is minimal, thereby inhibiting any tendency of the web to flutter relative to the supporting felts 56 and 72, respectively.

As shown in FIG. 3, the apparatus 10 also includes a base frame 78 for rotatably supporting both the first and the second plurality of dryers such that the axis of the first and second plurality of dryers are disposed in a first plane 80 as shown in FIG. 3.

Additionally, the frame 78 rotatably supports the first and second plurality of vacuum rolls 100 to 106 such that the axis of the first and the second plurality of vacuum rolls are disposed in a second plane 82 shown in FIG. 3. The first plane 80 is disposed above the second plane 82 as shown in FIG. 3.

As shown in FIG. 3, the apparatus 10 includes an upstream vacuum roll 64 of the second plurality of vacuum rolls, and this vacuum roll 64 is disposed in spaced close proximity to the unfelted portion 74 of the downstream dryer 42 of the first dryer section 26.

A first felt roll 84 is rotatably supported by the base frame 78 for guiding the second felt 72 past, and in conformity with, the unfelted portion 74 of the downstream dryer 42 and thereafter around the upstream vacuum roll 64 of the second dryer section 28 such that the web 12 is transferred from the unfelted portion 74 to the second felt 72 without open draw.

As shown in FIG. 2 referred to hereinbefore, the apparatus 10 includes a first transfer means 20 for transferring the web 12 from the press section 14 to the first dryer section means 16. This first transfer means 20 further includes a lead-in roll 86 which is disposed in spaced close proximity relative to the press section 14. The first felt 56 extends around this lead-in roll 86 for transferring the web 12 from the press section 14 to the first dryer section means 16.

A guide roll 88 is disposed between the lead-in roll 86 and the first dryer section means 16 for assisting the transfer of the web 12 from the press section 14 towards the first dryer section means 16.

A transfer felt 90 extends around the guide roll 88 such that the transfer felt 90 and the first felt 56 define therebetween a transfer section 92 for transferring the web 12 from the press section 14 toward the first dryer section means 16.

With further reference to FIG. 2, the first transfer means 20 further includes an upstream vacuum roll 44 of said first dryer section means 16. The upstream vacuum roll 44 cooperates with the first felt 56 and the transfer felt 90 such that the transfer section 92 extends from the guide roll 88 to the upstream vacuum roll 44 so that the web 12 emerging from the transfer section 92 is guided around the upstream vacuum roll 44 into the first dryer section means 16.

Figure 4:
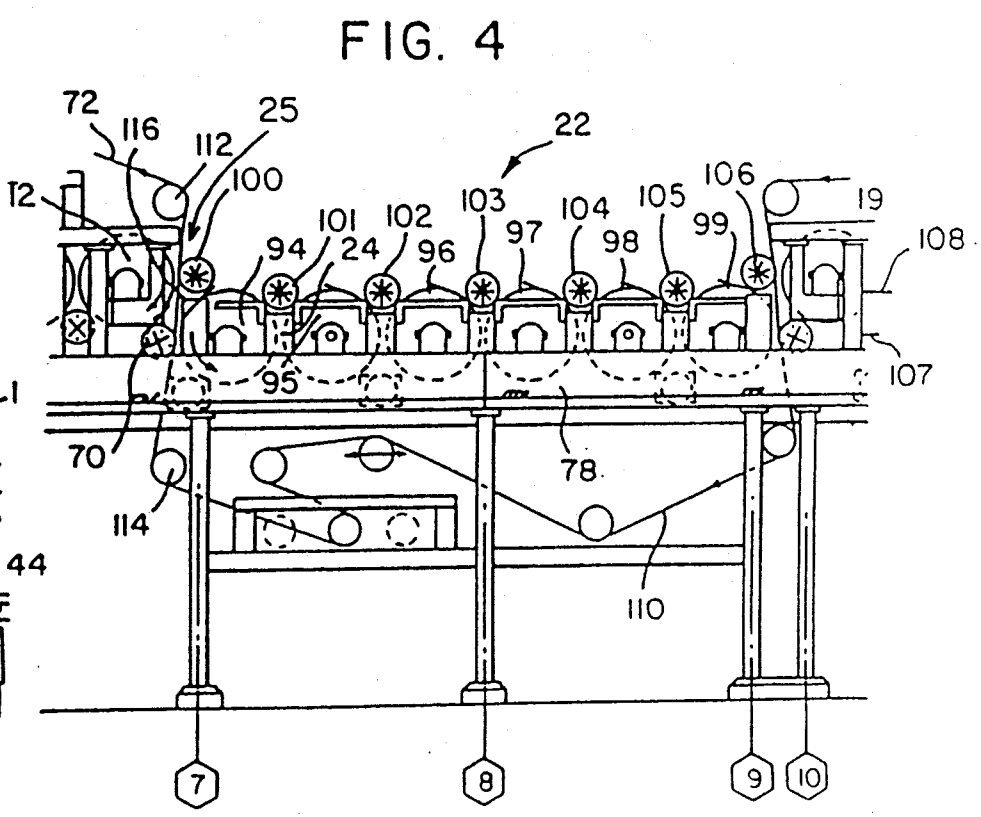
FIG. 4 is an enlarged fragmentary view of FIG. 1 showing the second dryer section means.

With reference to FIG. 4, the second dryer section means 22 also includes a third plurality of dryers 94, 95, 96, 97, 98 and 99, the third plurality of dryers being disposed downstream relative to the first dryer section means 16.

A third plurality of vacuum rolls 100, 10I, 102, 103, 104, 105 and 106 are disposed in spaced close proximity relative to a corresponding dryer of the third plurality of dryers such that the web 12 extends alternately past each vacuum roll and dryer of the second dryer section means 22 in serpentine configuration.

As shown in FIG. 4, the base frame 78 rotatably supports each of the dryers of the third plurality of dryers such that the axis of the dryers are disposed in the third plane 107.

The base frame 78 also rotatably supports each of the vacuum rolls such that the axis of each of the vacuum rolls of the third plurality of vacuum rolls are disposed in a fourth plane 108 with the fourth plane being disposed above the third plane.

A third felt 110 extends past the third plurality of dryers 94 to 99 and vacuum rolls 100 to 106 such that the third felt 110 supports the web through the second dryer section means 22 with the second side 24 of the web being urged by the third felt 110 into close conformity with each dryer of the third plurality of dryers 94 to 99.

As shown in FIG. 4, the first dryer transfer means 25 includes a downstream vacuum roll 70 of the first dryer section means 16 and a downstream felt roll 112 of the first dryer section 16.

The second felt 72 of the first dryer section means 16 extends between the downstream vacuum roll 70 and the downstream felt roll 112. The second felt 72 supports the web 12 such that the web is conveyed and disposed between the second felt 72 and the second dryer section means 22.

The first dryer transfer means 25 also includes an upstream vacuum rolls 100 and an upstream felt roll 114. The third felt 110 extends between the upstream felt roll 114 and the upstream vacuum roll 100 of the second dryer section means 22 such that the third felt 110 and the second felt 72 define therebetween a first dryer transfer means section 116 for transferring the web without open draw from the second to the third felts 72 and 110, respectively.

The third felt 110 presses against the web such that the second side 24 of the web is pressed into close conformity with each dryer of the third plurality of dryers 94 to 99 such that the second side 24 of the web is dried.

Figure 6:
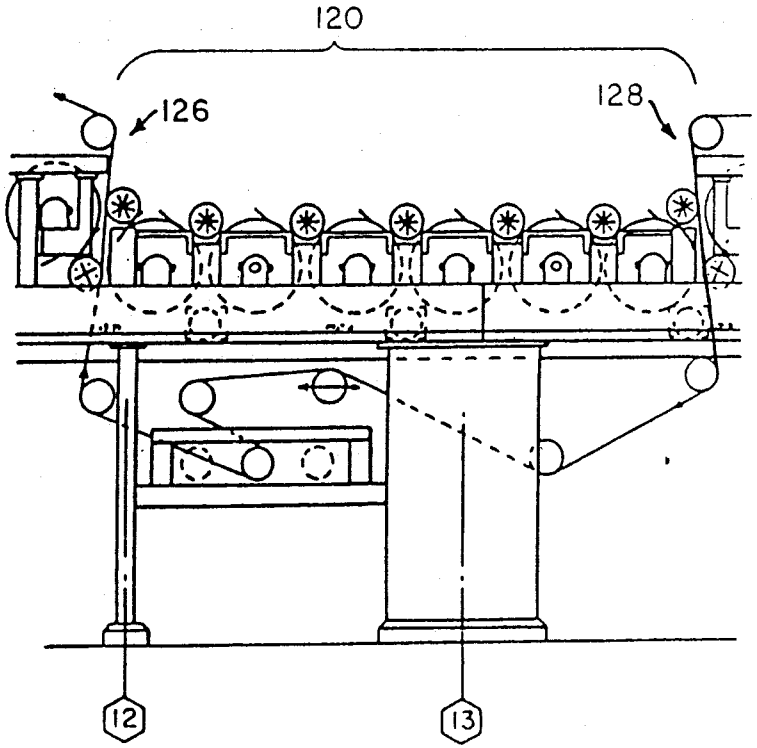
FIG. 6 is an enlarged fragmentary view of FIG. 1 showing the fourth dryer section means.
Figure 5:
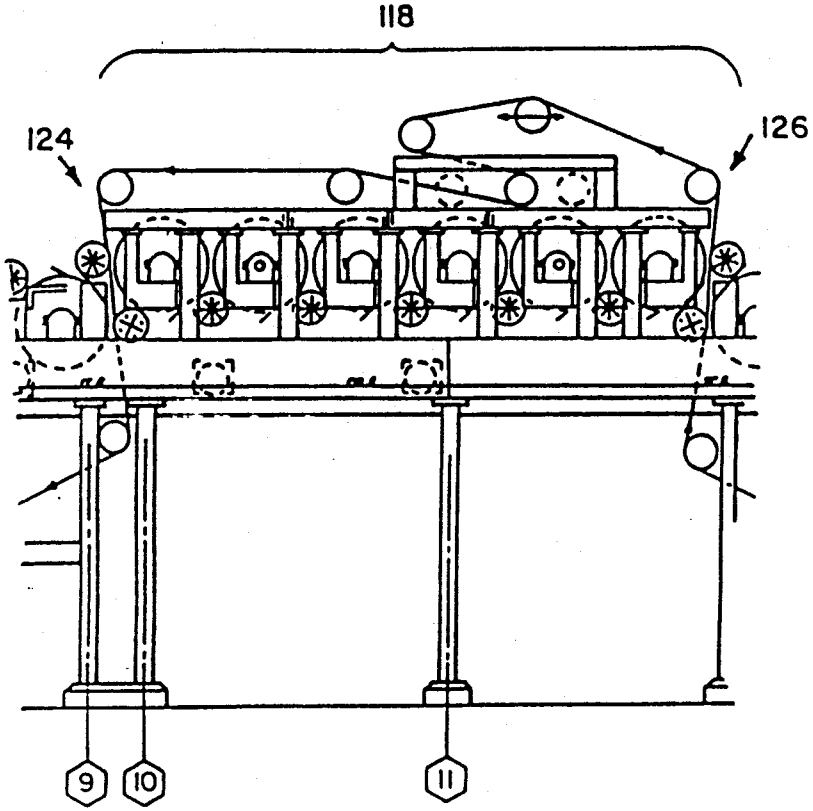
FIG. 5 is an enlarged fragmentary view of the third dryer section means.
Figure 7:
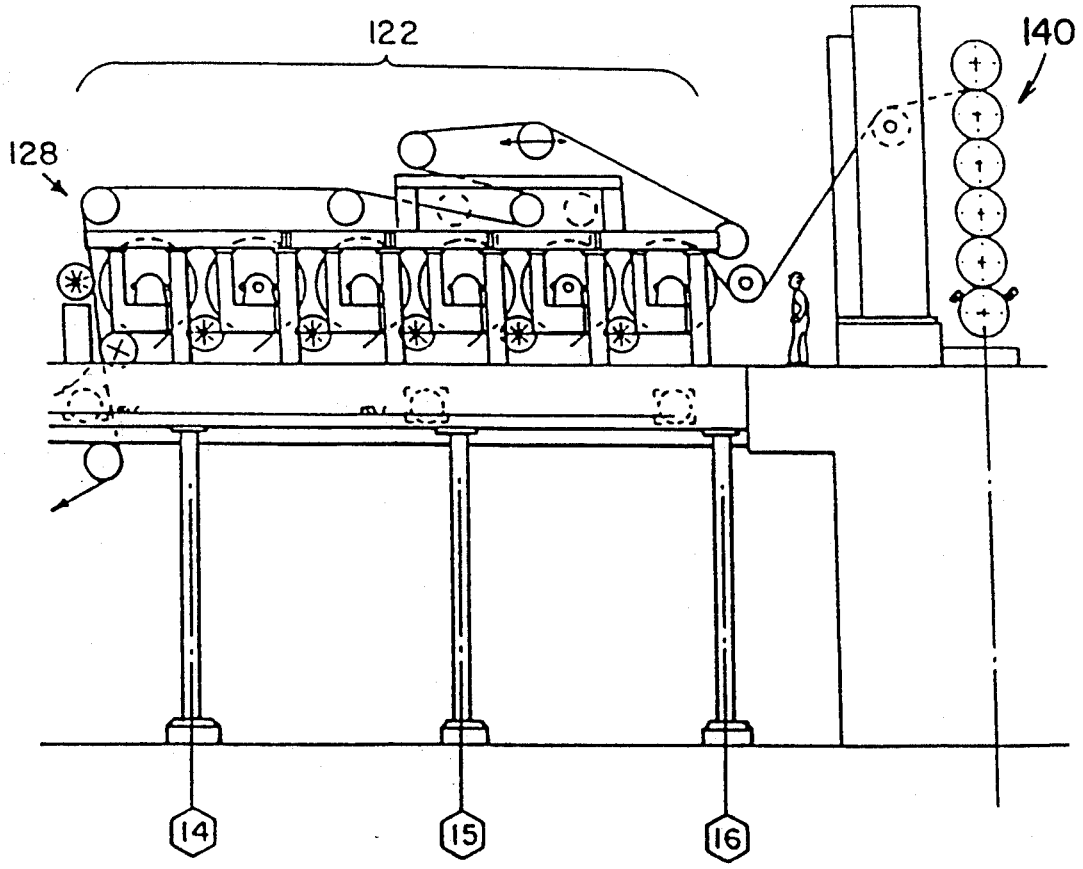
FIG. 7 is an enlarged fragmentary view of FIG. 1 showing the fifth dryer section means.

FIGS. 5, 6 and 7, respectively, show third, fourth and fifth dryer section means 118, 120 and 122, respectively, and third, fourth and fifth dryer transfer means 124, 126 and 128, respectively, for transferring and reversing the web as the web progresses through the drying apparatus. The first, third, fourth and fifth dryer transfer means 25, 124, 126 and 128 permit the transfer of the web between the respective dryer sections 16, 22, 118, 120 and 122 without open draw and with an alternate reversing of the web such that the first and second sides of the web are alternately dried as the web extends through the apparatus and past succeeding dryer section means.

Figure 8:
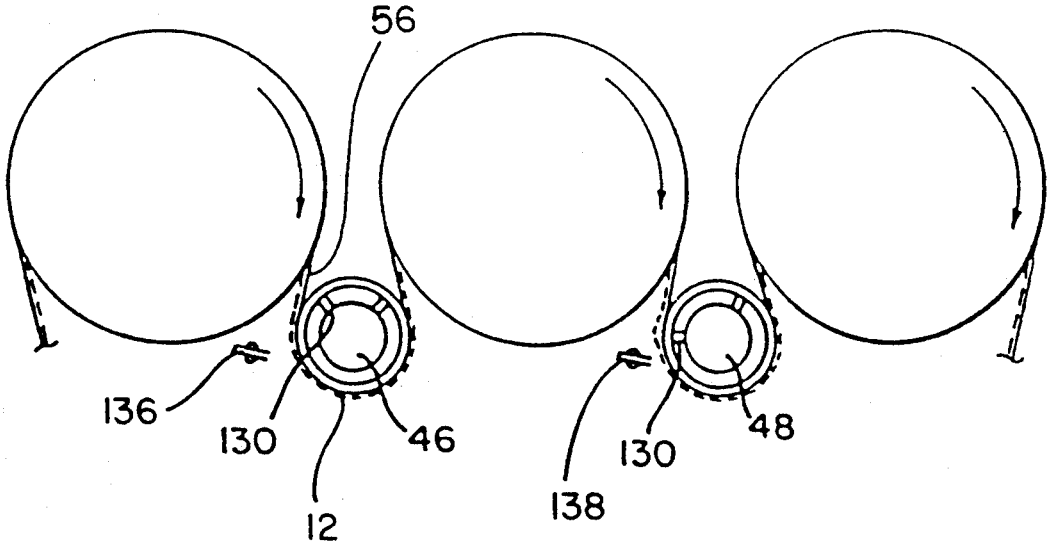
FIG. 8 is a side-elevational view of the present invention showing two of the vacuum rolls.

FIG. 8 shows the details of two of the vacuum rolls 46, 48 in which seals or pressure seals 130 may be moved from the position shown with reference to the roll 46 to that shown relative to roll 48 for counteracting the tendency of the web 12 to part from the felt 56.

Additionally, as shown in FIG. 8, air nozzles 136 and 138 are disposed adjacent the vacuum rolls 46 and 48. The special air nozzles 136 and 138 are located near the edges of each dryer to ensure that the tail of the web follows the felt 56 and is transferred by the vacuum rolls 46 and 48. These air nozzles 136, 138 are disposed adjacent to each of the vacuum rolls to eliminate the need for threading ropes, threading equipment and maintenance.

In one embodiment of the present invention, as shown in FIGS. 1–9, a single tier drying section, generally designated 16, for drying a web comprises, in combination, a dryer 63 and a felt 72 guided about the dryer 63 such that the web is disposed between the dryer 63 and the felt 72 for drying a first side 18 of the web 12. A further dryer 94 is disposed downstream relative to the dryer 63, and a further felt 110 is guided about the further dryer 94 such that the web is disposed between the further dryer 94 and the further felt 110 for drying a second side 24 of the web. A dryer transfer means 25 transfers the web without open draw from the dryer 63 to the further dryer 94.

More particularly, a dryer transfer means section 116 transfers the web without open draw from the dryer 63 to the further dryer 94.

Additionally, the dryer transfer means section 116 includes a joint run of the felt 72 and the further felt 110 such that the web is disposed between the felt 72 and the further felt 110 during passage through the joint run.

Also, the dryer transfer means section 116 further includes vacuum means 100 disposed downstream relative to the joint run for positively maintaining the web 12 in close conformity with the further felt 110 when the felt 72 and further felt 110 diverge relative to each other downstream relative to the joint run.

In a specific embodiment of the present invention, the vacuum means 100 is a vacuum roll.

Preferably, the single tier drying sections extends from a press section 14 to a calender section 140 shown in FIG. 7 or to a size press (not shown) or throughout the entire dryer section. The single tier drying section includes a multiplicity of single tier subsections 16, 22, 118, 120 and 122. The dryer transfer means section 116 is repeated along the plurality of transfer mechanisms 124, 126 and 128. Each of the transfer mechanisms or dryer transfer means 25, 124, 126 and 128 are disposed between adjacent subsections such that as the web progresses through subsequent subsections 16, 22, 118, 120 and 122, alternate sides of the web are dried.

The arrangement is such that alternate sides 18 and 24 of the web are sequentially dried as the web progresses through the subsections 16, 22, 118, 120 and 122.

Additionally, the subsections 16, 22, 118, 120 and 122 are disposed at different heights relative to each other and preferably every other subsection 16, 118, 122, and 22 and 120 are disposed at the same height relative to each other.

Figure 9:
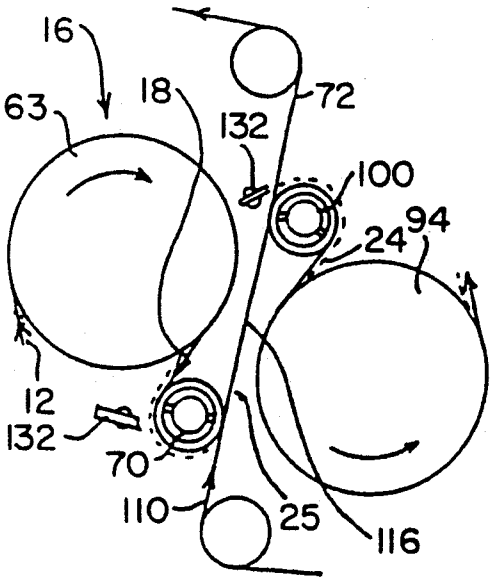
FIG. 9 is a side-elevational view of one embodiment of the present invention showing the air nozzle means for assisting guidance of the tail of the web from the dryer to the further dryer.

As shown particularly in FIG. 9, the dryer transfer means section 116 also includes air nozzle means 132 for assisting guidance of the web from the dryer 63 to the further dryer 94.

Figure 10:
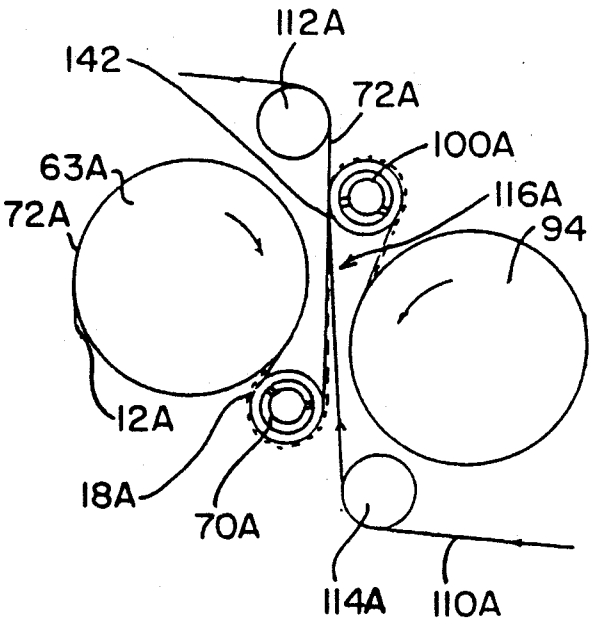
FIG. 10 is a side-elevational view of a further embodiment of the present invention showing a converging nip transfer.

In an alternative embodiment shown in FIG. 10, a web 12A is sandwiched between a felt 72A and a dryer 63A for drying a first side 18A of the web 12A. The web 12A supported by the felt 72A is immediately guided around a vacuum roll 70A such that the felt 72A is sandwiched between the web 12A and the vacuum roll 70A for restraining the web 12A against machine direction and cross-machine direction shrinkage. The restrained web 12A, thereafter supported by the felt 72A, extends through a first dryer transfer means section 116A. The felt 72A is thereafter guided around guide roll 112A.

A further felt 110A is guided about a guide roll 114A. The felt 110A extends from the guide roll 114A towards and around a vacuum roll 100A disposed closely adjacent to the felt 72A such that a converging nip 142 is defined between the felts 72A and 110A. The arrangement is such that as the web 12 moves from the vacuum roll 70A towards the vacuum roll 100A, the web 12A moves towards the converging nip 142. The vacuum within roll 100A causes the web to follow the felt 110A as the felt 110A diverges relative to the felt 72A. The felts 72A and 110A are free of stationary restraining means in the vicinity of the point where the felt 110A diverges relative to the felt 72A.

The term free of stationary restraining means in the present specification means free from a vacuum box or the like.

Figure 11:
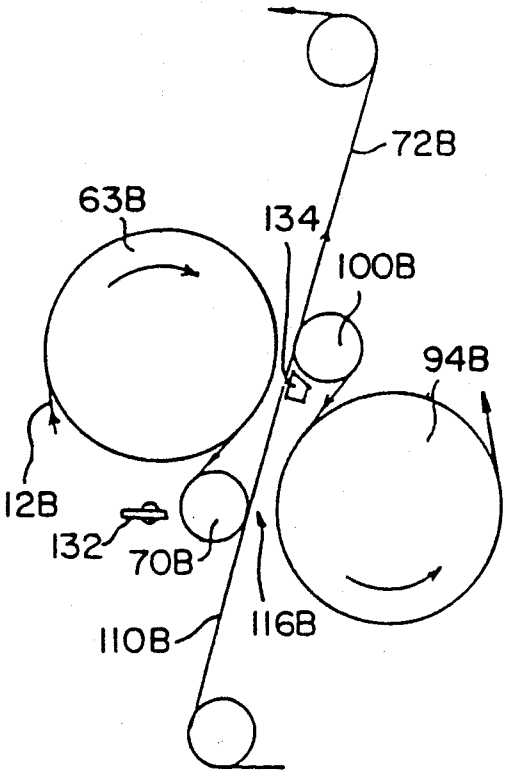
FIG. 11 is a side-elevational view of another embodiment of the present invention showing a transfer box.

In a further embodiment of the present invention as shown in FIG. 11, the transfer mechanism includes a transfer box 134 adjacent to a turning roll 100B which may be grooved. The transfer box 134 may be a vacuum box or a blow box having a Coanda effect nozzle for transferring the web so that the web follows roll 100B.

Figure 12:
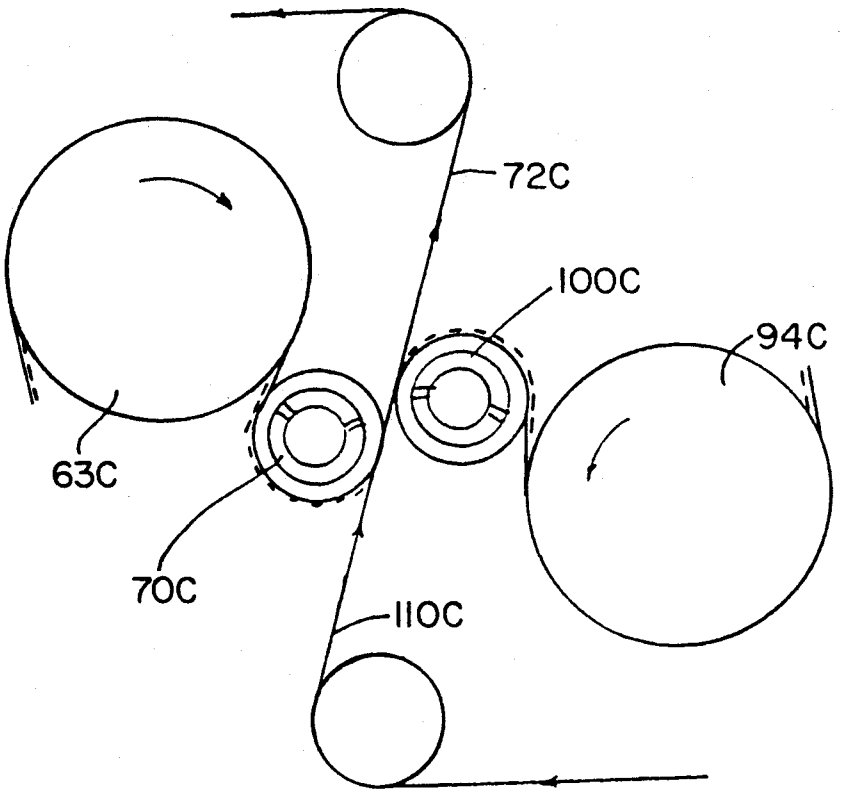
FIG. 12 is a side-elevational view of a further embodiment of the present invention in which the joint run of the felts is minimal.

FIG. 12 is a side-elevational view of a further embodiment of the present invention wherein the transfer mechanism includes a vacuum roll 70C and a vacuum roll 100C disposed in close proximity relative to each other such that the joint run of felts 72C and 110C is minimal.

In each of the embodiments, the ratio of the diameter of the vacuum roll, or the transfer roll, relative to the diameter of the dryer, or further dryer, or upstream or downstream dryers, is within the range 1:2 to 1:4.

In operation of the apparatus, the web is transferred from the press section 14 to a first dryer section means 16 of the apparatus. Drying of the first side 18 of the web is initiated during passage of the web through the first dryer section means 16. The web is transferred without open draw between the first dryer section 16 and a downstream second dryer section means 22 with the web transfer being such that the web is reversed so that drying of the second side 24 of the web is initiated during passage of the web through the second dryer section means 22.

In operation of the apparatus, the web is also transferred without open draw between subsequent dryer sections 118, 120, 122 such that the first and second sides 18, 24 of the web are alternately exposed to the drying effect of the subsequent dryer section in sequence.

As shown in FIGS. 1–12, a single tier drying section 28 for drying a web includes a dryer 63 and a felt 72 guided about the dryer 63 such that the web, as shown in dotted-out line in FIG. 9, is disposed between the dryer 63 and the felt 72 for drying a first side 18 of the web.

A further dryer 94 is disposed downstream relative to the dryer 63, as shown in FIGS. 9 and 10.

A further felt 110 is guided about the further dryer 94 such that the web is disposed between the further dryer 94 and the further felt 110 for drying a second side 24 of the web.

Dryer transfer means, generally designated 25, transfers the web from the dryer 63 to the further dryer 94.

The dryer transfer means 25 transfers the web without open draw from the dryer 63 to the further dryer 94.

The dryer transfer means 25 further includes a joint run 116,116A and 116B, as shown in FIGS. 9–11, of the felt 72 and further felt 110 such that the web is conveyed by the felt 72 into close proximity to the further felt 110 during passage through the joint run.

Vacuum means 100,100A,100B,134 and 100C, as shown in FIGS. 9–12, are disposed downstream of the joint run for positively maintain the web in close conformity with the further felt 110 when the felt 72 and further felt 110 diverge relative to each other downstream of the joint run.

The felt 72 is free from restraining means on the side of the felt facing away from the web during passage of the felt 72 and further felt 110 through the joint run.

Additionally, a single tier drying section 28, as shown in FIG. 3, for drying a web includes a first plurality of dryer cylinders 58 to 63 for drying a first side of the web.

A first plurality of vacuum rolls 65 to 69 are disposed below and interposed between adjacent dryer cylinders of the first plurality of dryer cylinders.

Looped dryer felt means 72 conveys the web in a serpentine path over the first plurality of dryer cylinders 58 to 63 with the web between the felt 72 and the dryer cylinders and under the first plurality of vacuum rolls 65 to 69 with the felt between the web and the vacuum rolls.

The vacuum rolls are spaced in close proximity to their adjacent corresponding dryer cylinders such that a felt draw between each of the vacuum rolls and the corresponding dryer cylinders of the first plurality of dryer cylinders 58 to 63 and the first plurality of vacuum rolls 65 to 69 is minimal, thereby inhibiting any tendency of the web to flutter relative to the dryer felt draws.

Each of the felt draws is free of restraint, and a second plurality of dryer cylinders 94 to 99 dry a second side of the web.

A second plurality of vacuum rolls 101 to 105 are arranged such that each vacuum roll is disposed above and interposed between adjacent dryer cylinders of the second plurality of dryer cylinders 94 to 99.

A looped further dryer felt 110 conveys the web in a serpentine path under the second plurality of dryer cylinders 94 to 99 and over the second plurality of vacuum rolls 101 to 105. The vacuum rolls are spaced in close proximity to their adjacent corresponding dryer cylinders such that a further felt draw between each of the vacuum rolls and the corresponding dryer cylinders of the second plurality of dryer cylinders is minimal, thereby inhibiting any tendency of the web to flutter relative to the further dryer felt draws.

Each of the further felt draws is free of restraint.

The first plurality of dryer cylinders 58 to 63 shown in FIG. 3 are disposed substantially horizontal in series.

Also, the second plurality of dryer cylinders 94 to 99 shown in FIG. 4 are disposed substantially horizontal in series following the first plurality of dryer cylinders.

Transfer means 25 is disposed between the first and second plurality of dryer cylinders for transferring the web from the felt means 72 to the further felt 110 without open draw. The means 25 includes at least one vacuum roll 100 associated with the further felt 110 and having an internal suction gland or pressure seals 130 positioned to remove the web from the looped dryer felt means 72 and onto the further felt 110.

Additionally, as shown in FIGS. 1 to 12, a method of drying a web of paper emerging from a press section of a papermaking machine includes the steps of transferring the web from the press section to a single tier first dryer section 26 of the apparatus, as shown in FIG. 3.

Initiating the drying of the first side of the web during passage of the web through the first dryer section 26.

Transferring the web without open draw between the first dryer section 26 and a second dryer section 22, shown in FIG. 1. The web is transferred such that the web is reversed so that drying of a second side of the web is initiated during passage of the web through the second dryer section 22. The second side of the web is opposite to the first side of the web.

The method includes the further step of transferring the web without open draw between subsequent dryer sections 118,120 and 122 such that the first and second sides of the web are alternately exposed to the drying effect of the subsequent drying sections in sequence and restraining the web during passage through the drying sections 22,118,120 and 122 for reducing machine and cross-machine directional shrinkage.

Additionally, a single tier drying section for drying a web including a first plurality of drying cylinders 58 to 63, as shown in FIG. 3.

A first plurality of vacuum rolls 65 to 69, as shown in FIG. 3, with each vacuum roll of the plurality of vacuum rolls being disposed below and between adjacent drying cylinders of the first plurality of drying cylinders and being disposed in close proximity thereto.

A second plurality of drying cylinders 94 to 99 are disposed downstream relative to the first plurality of drying cylinders, as shown in FIG. 4.

A second plurality of vacuum rolls 101 to 105, as shown in FIG. 4, are disposed above and between adjacent drying cylinders of the second plurality of drying cylinders and are disposed in close proximity thereto.

The first plurality of drying cylinders 58 to 63 have axes of rotation which extend generally horizontally in a plane 80, as shown in FIG. 3.

The second plurality of drying cylinders 94 to 99 have axes of rotation extending generally horizontally in a further plane 107, as shown in FIG. 4. The plane 80 and further plane 107 are at different elevations.

More particularly, as shown in FIGS. 3 and 4, the plane 80 is disposed above the plane 107.

Each of the vacuum rolls of the first and second plurality of vacuum rolls have a diameter which is less than the diameter of the first and second plurality of dryer cylinders 58 to 63 and 94 to 99.

Additionally, a papermachine drying apparatus for drying a first and a second side of the web includes a first drying section 28, shown in FIG. 3, for drying only the first side of the web. The first drying section 28 includes a first plurality of dryer cylinders 58 to 63 for drying the first side of the web. Each dryer cylinder 58 to 63 has an axis of rotation disposed in a first plane 80.

A first plurality of vacuum rolls 65 to 69 are arranged such that they are disposed in close proximity between adjacent dryer cylinders of the first plurality of dryer cylinders 58 to 63. Each vacuum roll of the first plurality of vacuum rolls 65 to 69 is disposed in a second plane 82, as shown in FIG. 3.

A second drying section 22, shown in FIG. 1, dries only the second side of the web. The second drying section 22, shown in more detail in FIG. 4, includes a second plurality of dryer cylinders 94 to 99 for drying the second side of the web. The second plurality of dryer cylinders 94 to 99 are disposed immediately downstream relative to the first drying section 28 shown in FIG. 3. Each dryer cylinder 94 to 99 has an axis of rotation disposed in a third plane 107, shown in FIG. 4.

A second plurality of vacuum rolls 101 to 105 is arranged such that each vacuum roll is disposed in close proximity between adjacent dryer cylinders of the second plurality of dryer cylinders 94 to 99 with each vacuum roll being disposed in a fourth plane 108 as shown in FIG. 4.

The fourth plane 108 is disposed between the first and second planes 80,82 as shown in FIG. 3, and at least one of the vacuum rolls is smaller in diameter than the diameter of any of the dryer cylinders of the first and second drying sections 28 and 22.

Additionally, at least one of the vacuum rolls of the first and second plurality of vacuum rolls has a larger diameter than at least one of the remaining rolls of the first and second plurality of vacuum rolls.

The first plurality of dryer cylinders 58 to 63 are disposed as a single tier, and the second plurality of dryer cylinders 94 to 99 are disposed as a further single tier.

More specifically, the drying apparatus includes a dryer felt 72 which cooperates with each of the dryer cylinders 58 to 63 such that the web is disposed between the felt 72 and the dryer cylinders 58 to 63 for drying the first side of the web. The felt 72 extends in serpentine configuration alternately around each dryer cylinder and each vacuum roll 65 to 69 so that the felt 72 is disposed between the web and each of the vacuum rolls.

A further dryer felt 110, as shown in FIG. 4, cooperates with each of the dryer cylinders 94 to 99 of the second drying section 22 such that the web is disposed between the further felt 110 and the dryer cylinders 94 to 99. The further felt 110 extends in serpentine configuration alternately around each dryer cylinder and each vacuum roll so that the further felt 110 is disposed between the web and each of the vacuum rolls 101 to 105.

More specifically, the first, second, third and fourth planes are all disposed substantially horizontal.

FIGS. 13 to 18 are diagrammatic representations of various embodiments of the present invention, that is the fifth to tenth embodiment, respectively.

In each of the embodiments of FIGS. 13 to 18, the first plurality of dryer cylinders 61D,E,F,G,H,I to 63D,E,F,G,H,I, respectively, are disposed in a first plane, designated I, which corresponds with 80 shown in FIG. 3.

A first plurality of vacuum rolls 68D,E,F,G,H,I to 69D,E,F,G,H,I are disposed in a second plane, designated II, which corresponds with 82 shown in FIG. 3.

A second plurality of dryer cylinders 94D,E,F,G,H,I to 96D,E,F,G,H,I are disposed in a third plane, designated III, which corresponds with 107 shown in FIG. 4.

A second plurality of vacuum rolls 101D,E,F,G,H,I to 102D,E,F,G,H,I are disposed in a fourth plane, designated IV, which corresponds with 108 shown in FIG. 4.

Figure 13:
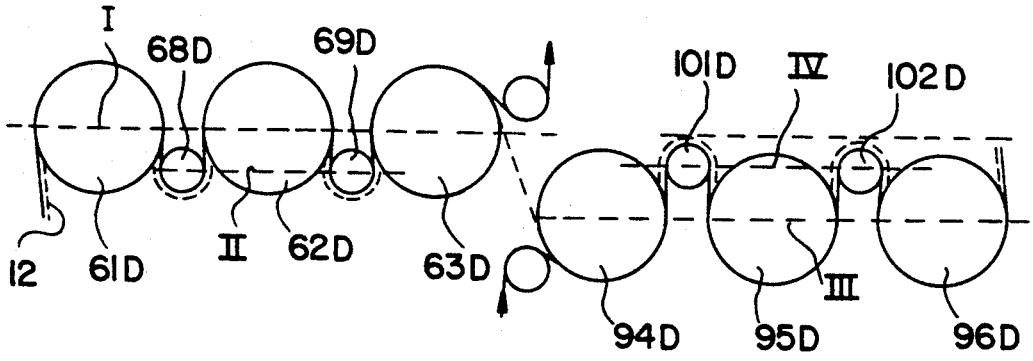
FIG. 13 is a diagrammatic representation of a fifth embodiment of present invention.
Figure 14:
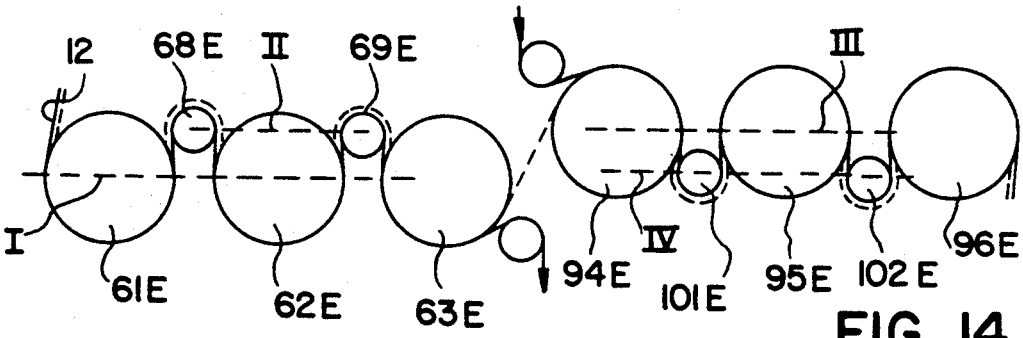
FIG. 14 is a similar view to that shown in FIG. 13 but shows a sixth embodiment of the present invention.

The arrangement is such that in FIGS. 13 and 14, the plane IV is disposed between planes I and II.

Figure 15:
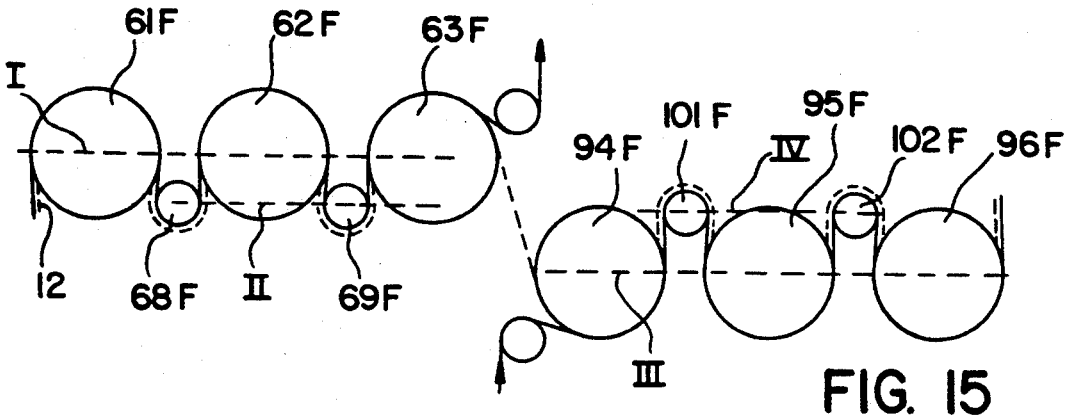
FIG. 15 is a similar view to that shown in FIG. 13 but shows a seventh embodiment of the present invention.
Figure 16:
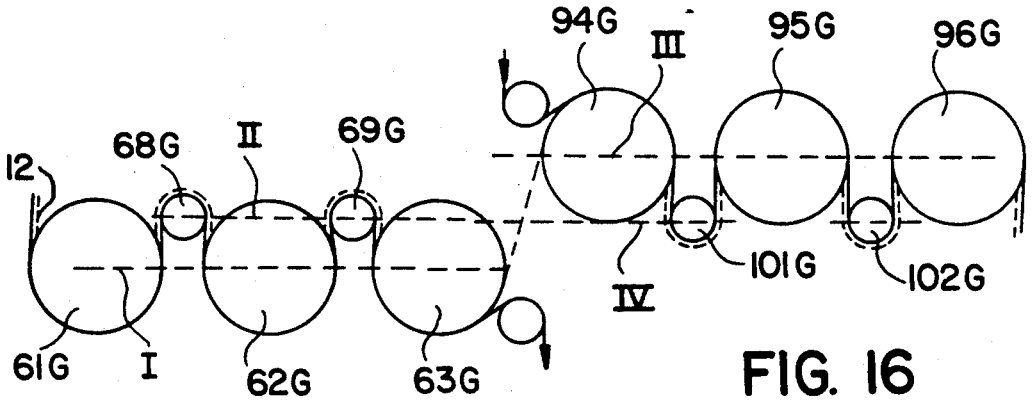
FIG. 16 is a similar view to that shown in FIG. 13 but shows an eighth embodiment of the present invention.

In FIGS. 15 and 16, planes II and IV are co-planar and disposed between planes I and III.

Figure 17:
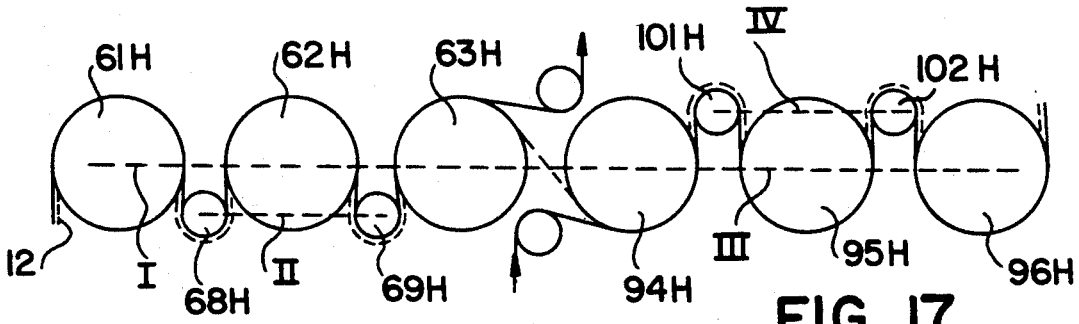
FIG. 17 is a similar view to that shown in FIG. 13 but shows a ninth embodiment of the present invention.
Figure 18:
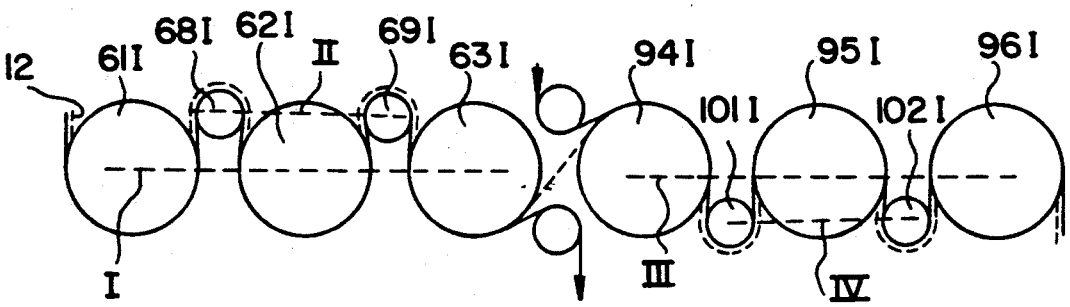
FIG. 18 is a similar view to that shown in FIG. 13 but shows a tenth embodiment of the present invention.

In FIGS. 17 and 18, planes I and III are co-planar and disposed between planes II and IV.

In each of the embodiments shown in FIGS. 13 to 18, the second drying section 94D to 96D and 101D to 102D, shown in FIG. 13, and the corresponding elements in FIGS. 14 to 18 are a displaced downstream mirror image of the first drying section 61D to 63D and 68D to 69D of FIG. 13 and the corresponding elements in FIGS. 14 to 18.

Those skilled in the art will appreciate that restraint of the web can be accomplished by minimizing the distance between the dryer shell and the adjacent vacuum roll, as stated hereinbefore, or by other means, such as blow boxes which increase the affinity of the web to the felt without directly restraining the web.

The present invention provides a drying section which is capable of operating at extremely high speeds as no open draw exists between the various sections thereof. Furthermore, the present invention enables threading of the drying section without the use of threading ropes. Additionally, the web is dried while being restrained against machine and cross-machine directional shrinkage, thereby reducing curl in the resultant web.

What is claimed is:

1. A single tier drying section for drying a web comprising:

a first plurality of drying cylinders;

a first plurality of vacuum rolls, each vacuum roll of said plurality of vacuum rolls being disposed below and between adjacent drying cylinders of said first plurality of drying cylinders and being disposed in close proximity thereto;

a second plurality of drying cylinders disposed downstream relative to said first plurality of drying cylinders;

a second plurality of vacuum rolls, each of said vacuum rolls of said second plurality of vacuum rolls being disposed above and between adjacent drying cylinders of said second plurality of drying cylinders and being disposed in close proximity thereto;

said first plurality of drying cylinders having axes of rotation which extend generally horizontally in a plane;

said second plurality of drying cylinders having axes of rotation extending generally horizontally in a further plane; and said plane and further plane being at different elevations.

2. A single tier drying section as set forth in claim 1 wherein said plane is above said further plane.

3. A single tier dryer section as set forth in claim 1 wherein each of said vacuum rolls of said first and second plurality of vacuum rolls have a diameter which is less than the diameter of said first and second plurality of dryer cylinders.

4. A papermachine drying apparatus for drying a first and a second side of a web, said apparatus comprising:

a first drying section for drying only the first side of the web, said first drying section including:

a first plurality of dryer cylinders for drying the first side of the web, each dryer cylinder of said first plurality of dryer cylinders having an axis of rotation disposed in a first plane;

a first plurality of vacuum rolls, each vacuum roll of said first plurality of vacuum rolls being disposed in close proximity between adjacent dryer cylinders of said first plurality of dryer cylinders, each vacuum roll of said first plurality of vacuum rolls being disposed in a second plane;

a second drying section for drying only the second side of the web, said second drying section including:

a second plurality of dryer cylinders for drying the second side of the web, said second plurality of dryer cylinders being disposed immediately downstream relative to said first drying section, each dryer cylinder of said second plurality of dryer cylinders having an axis of rotation disposed in a third plane;

a second plurality of vacuum rolls, each vacuum roll of said second plurality of vacuum rolls being disposed in close proximity between adjacent dryer cylinders of said second plurality of dryer cylinders, each vacuum roll of said second plurality of vacuum rolls being disposed in a fourth plane; and said fourth plane being disposed between said first and second planes.

5. A papermachine drying apparatus as set forth in claim 4, wherein at least one of said vacuum rolls of said first and second plurality of vacuum rolls being smaller in diameter than the diameter of any of said dryer cylinders of said first and second drying sections, and at least one of said vacuum rolls of said first and second plurality of vacuum rolls has a larger diameter than at least one of the remaining vacuum rolls of said first and second plurality of vacuum rolls.

6. A drying apparatus as set forth in claim 4, further including:

a dryer felt cooperating with each of said dryer cylinders of said first drying section such that the web is disposed between said felt and said dryer cylinders for drying the first side of the web, said felt extending in serpentine configuration alternately around each dryer cylinder and each vacuum roll of said plurality of vacuum rolls so that said felt is disposed between the web and each of said vacuum rolls;

a further dryer felt cooperating with each of said dryer cylinders of said second drying section such that the web is disposed between said further felt and said dryer cylinders of said second drying section for drying the second side of the web, said further felt extending in serpentine configuration alternately around each dryer cylinder of said second drying section and each vacuum roll of said second plurality of vacuum rolls so that said further felt is disposed between the web and each of said vacuum rolls of said second plurality of vacuum rolls.

7. A drying section apparatus as set forth in claim 4, wherein said first, second, third and fourth planes are disposed substantially horizontal.

8. A single tier drying section apparatus for drying a first and a second side of a web, said apparatus comprising:

a single tier of dryer cylinders for drying the first side of the web, each dryer cylinder having an axis of rotation disposed in a first plane;

a plurality of vacuum rolls, each vacuum roll being disposed in close proximity between adjacent dryer cylinders of said single tier of dryer cylinders, each vacuum roll of said plurality of vacuum rolls being disposed in a second plane;

a further single tier of dryer cylinders disposed immediately downstream relative to said single tier of dryer cylinders for drying the second side of the web, each dryer cylinder of said further single tier having an axis of rotation disposed in a third plane; and a further plurality of vacuum rolls, each vacuum roll of said further plurality of vacuum rolls being disposed in close proximity between adjacent dryer cylinders of said further single tier of dryer cylinders, each vacuum roll of said further plurality of vacuum rolls being disposed in a fourth plane, said second and fourth planes being co-planar, said second and fourth planes being disposed between and spaced and parallel relative to said first and third planes.

9. A single tier drying section apparatus as set forth in claim 8, wherein said first, second, third and fourth planes are disposed substantially horizontal.

10. A single tier drying section apparatus for drying a first and second side of a web, said apparatus comprising:

a single tier of dryer cylinders for drying the first side of the web, each dryer cylinder having an axis of rotation disposed in a first plane;

a plurality of vacuum rolls, each vacuum roll being disposed in close proximity between adjacent dryer cylinders of said single tier of dryer cylinders, each vacuum roll of said plurality of vacuum rolls being disposed in a second plane;

a further single tier of dryer cylinders disposed immediately downstream relative to said single tier of dryer cylinders for drying the second side of the web, each dryer cylinder of said further single tier having an axis of rotation disposed in a third plane; and a further plurality of vacuum rolls, each vacuum roll of said further plurality of vacuum rolls being disposed in close proximity between adjacent dryer cylinders of said further single tier of dryer cylinders, each vacuum roll of said further plurality of vacuum rolls being disposed in a fourth plane, said first and third planes being co-planar, said first and third planes being disposed between and parallel relative to said second and fourth planes.

* * * * *

UNITED STATES PATENT AND TRADEMARK OFFICE

CERTIFICATE OF CORRECTION

PATENT NO. : 5,144,758

DATED : September 8, 1992

INVENTOR(S) : Borgeir Skaugen; Gregory L. Wedel

It is certified that error appears in the above-identified patent and that said Letters Patent is hereby corrected as shown below:

On the Title Page

Lines 12-13: Please delete "which is a continuation-in-part" and insert --all of which are continuations-in-part-- in place thereof.

On the title page

Line 14: Please delete ", which is a continuation-in-part" and insert --. Continuation-in-part-- in place thereof.

Column 13, Lines 5-6: Between "each" and "configuration", please insert --vacuum roll 64 to 70 and dryer 58-63 in serpentine--.

Signed and Sealed this

Twentieth Day of July, 1993

*Attest:*

*Attesting Officer*

Michael K. Kirk

MICHAEL K. KIRK

*Acting Commissioner of Patents and Trademarks*